United States Patent [19]

Martin

[11] 3,958,729

[45] May 25, 1976

[54] CONTAINER WITH REVERSIBLE DISPENSER

[76] Inventor: Edward J. Martin, 5921 Oliver Ave. South, Minneapolis, Minn. 55419

[22] Filed: Aug. 16, 1974

[21] Appl. No.: 497,951

[52] U.S. Cl. ..... 222/539

[51] Int. Cl.[2] ..... B67D 5/00

[58] Field of Search.... 222/538, 539, 568, 519–521, 222/522–525, 553; 220/85 SD, 85 B, 85 S; 285/220

[56] References Cited

UNITED STATES PATENTS

| | | | |
|---|---|---|---|
| 1,205,666 | 11/1916 | Rosenfeld | 222/539 |
| 2,403,670 | 7/1946 | Martin | 285/220 X |
| 2,974,836 | 3/1961 | Gersten | 222/539 |
| 3,181,744 | 5/1965 | Hales | 222/539 |
| 3,606,399 | 9/1971 | Zahuranec | 285/220 |

*Primary Examiner*—Robert B. Reeves
*Assistant Examiner*—Norman L. Stack, Jr.
*Attorney, Agent, or Firm*—James R. Haller; H. Dale Palmatier

[57] ABSTRACT

A container dispenser including a reversible pouring spout and closure which in one position provides a closure for the container and which in the reverse position provides a spout for pouring liquid from the container. The dispenser includes a collar with an internal, annular gasket, the collar being mounted to a wall of the container, and a dispensing spout having an outer threaded end portion threadable from either end into the collar. The spout has an open end and a closed end with a side opening spaced from the closed end, the threaded end portion of the spout extending on either side of the side opening. When the spout is threaded from either end into the collar, the threaded portion of the spout sealing engages the gasket with the side opening of the spout open to the container interior.

13 Claims, 7 Drawing Figures

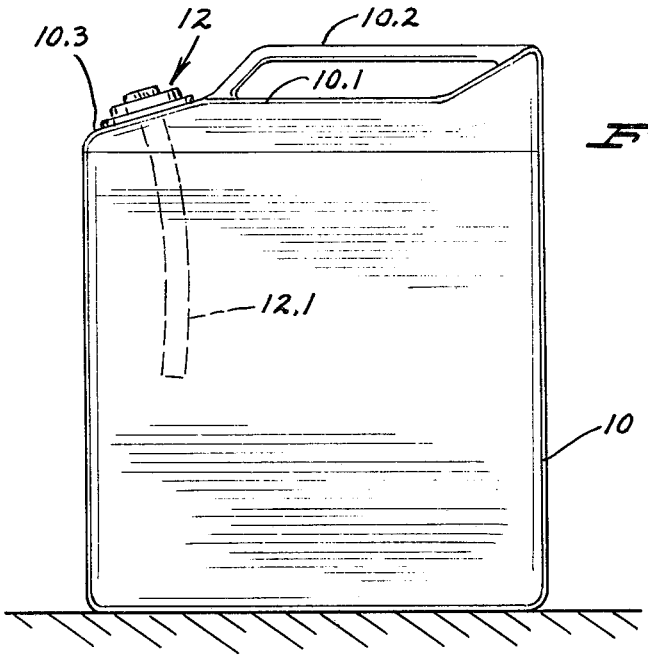
FIG. 1
FIG. 2
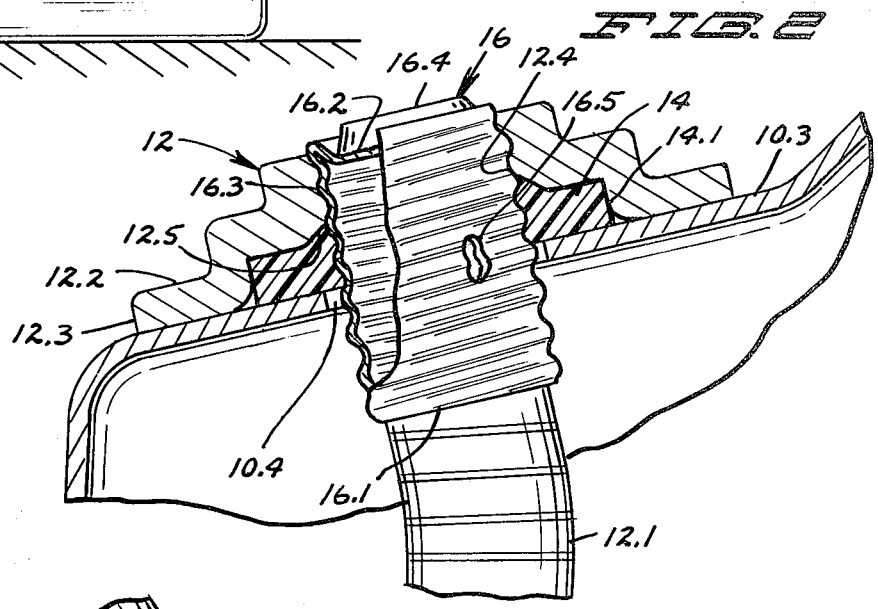
FIG. 3
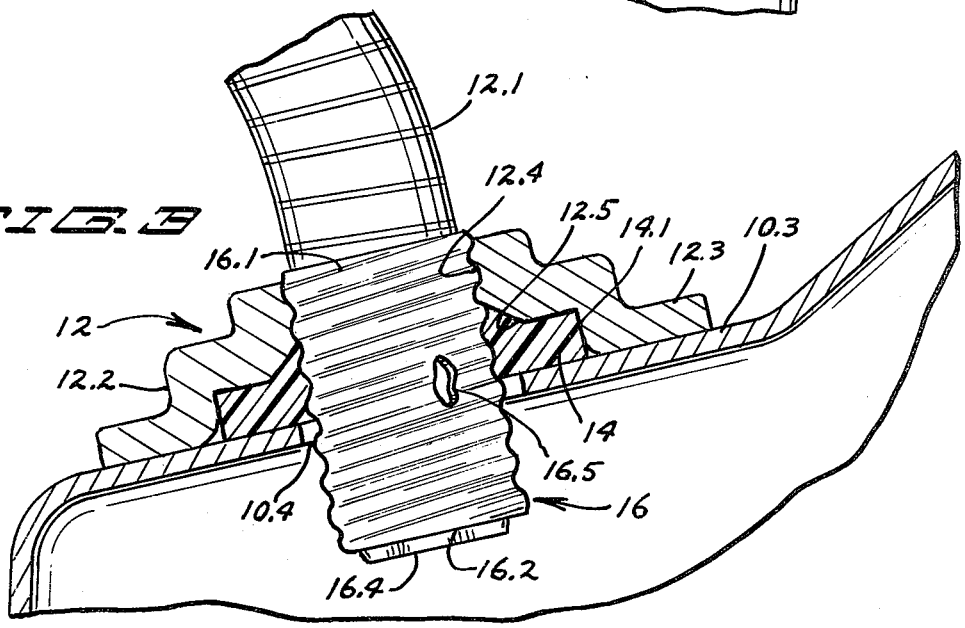

CONTAINER WITH REVERSIBLE DISPENSER

BACKGROUND OF THE INVENTION

Containers, such as gas cans and the like, are often provided with a spout to aid in pouring gas into the gas tank of a motor vehicle. These spouts often are slightly flexible so that the spout end may be inserted into a gas tank and the container may be tipped at various angles to obtain gravity flow of gas into the tank. The mouths of such containers ordinarily are threaded, and may be provided with a threaded cap which can be replaced with the threaded end of a pouring spout for the pouring operation. In U.S. Pat. No. 3,181,744, a spout for a container includes spaced threaded spout sections with a gasket moveable axially across a slotted center portion of reduced diameter from a position abutting one of the threaded sections to a position abutting the other threaded section as the spout is reversed in the container. Because of the rather tortuous design of the last-mentioned spout, its manufacture may be rather expensive, and its successful operation depends upon sliding, without binding, of the gasket across the slots between the two threaded sections. Moreover, since gas containers such as are used at resorts or for wilderness camping are often subjected to rough use, the exposed gasket on the last-mentioned dispenser is subject to damage which may adversely affect its operation.

A reversible dispenser which would avoid the problems associated with the prior art devices, which obviates the necessity of a separate cap for a container, and which is of simple, rugged, and relatively inexpensive manufacture, is much to be desired and would greatly advance the art.

BRIEF DESCRIPTION OF THE INVENTION

The invention relates to a container having a dispenser with a reversible pouring spout, the dispenser comprising a collar and pouring spout. The collar is mounted to a wall of a container and has an internally threaded bore open to the interior of the container. A deformable, annular gasket is supported internally by the collar and extends normally inwardly slightly of the collar bore and coaxially of the bore. An elongated dispensing spout having an open end and a closed end is provided with a side opening spaced from its closed end. The spout has an exteriorly threaded, unobstructed portion on either side of the side opening for threading the spout from either end into the collar with the threaded portion of the spout sealingly engaging the annular gasket and with the side opening of the spout open only to the container interior. When the pouring spout is threaded into the collar with the open spout and extending outwardly, gas or other liquid from the container may flow from the container interior through the side opening and thence through the open end of the spout into a gas tank or the like. When the spout is reversed, the side hole again is open to the container interior with the adjacent threaded portion of the spout adjacent its closed end sealing against the gasket, thus providing a positive closure for the container.

DESCRIPTION OF THE DRAWING

FIG. 1 is a side elevation of a typical gasoline container, provided with the dispenser of the invention;

FIG. 2 is a broken away, detailed cross-sectional view of a dispenser of the invention with the spout in position to provide a positive closure for the container;

FIG. 3 is a cross-sectional, broken away view similar to that of FIG. 2 but with the spout in the pouring position;

DETAILED DESCRIPTION OF THE PREFERRED EMBODIMENT

Figure 4:
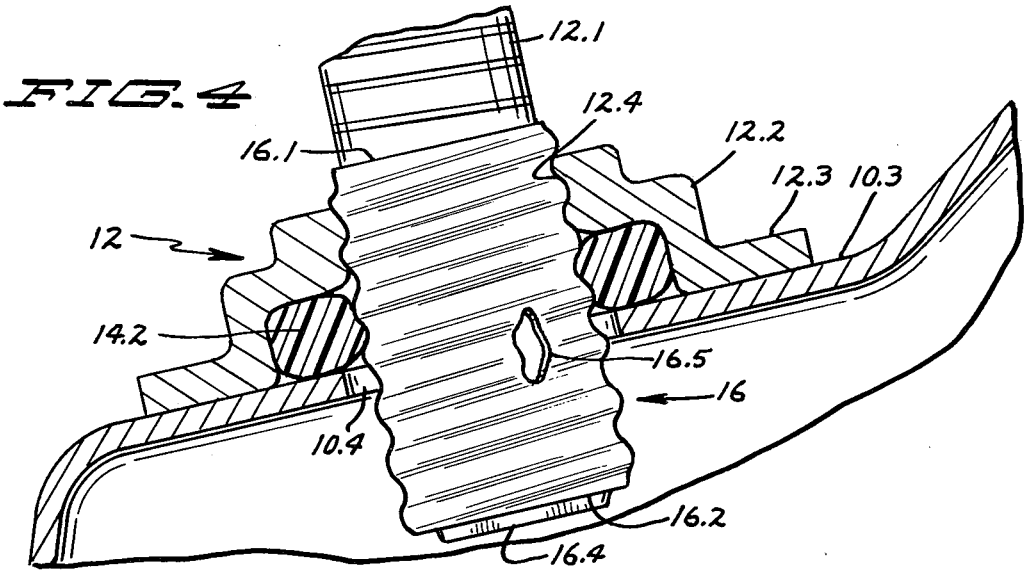
FIGS. 4 and 5 are broken away, cross-sectional views of slightly modified dispensers of the invention.

Referring first to FIG. 1, a liquid container 10 of the type known popularly as a "jerry can" is provided with an upper wall 10.1 having a welded-on handle 10.2. Near one side, the upper wall 10.1 of the container slopes downwardly slightly as designated by 10.3, the sloping section including a dispenser 12 of the invention. The depicted dispenser includes a section of flexible hose 12.1, shown in dashed lines in FIG. 1.

Referring now to FIGS. 2–6, the sloping upper wall 10.3 of the container is provided with a generally circular opening 10.4, and a generally disc-shaped collar 12.2 is affixed to the container over the hole 10.4. The collar 12.2 has an outer flange 12.3 which is welded or otherwise affixed to the outer surface of the container wall 10.3. The collar 12.2 is generally dished so as to provide an annular space between the outer surface of the container wall 10.3 and the collar, and is further provided with a central, threaded bore 12.4 which is aligned with the hole 10.4 in the top container wall, the diameter of the hole 10.4 being slightly greater than the largest diameter of the threaded bore of the collar. With reference to the embodiment of FIGS. 2 and 3, the edge 12.5 of the threaded bore of the collar nearest the hole 10.4 in the container wall is beveled slightly, as will be described in more detail below. The threaded bore 12.4 desirably includes at least two and not more than about four smooth, rounded threads.

An annular, deformable gasket 14 is positioned within the annular recess between the upper surface of the container wall 10.3 and the collar 12.2 with its outer periphery 14.1 being seated tightly within the annular recess. The radial width of the gasket 14 is such that its inner diameter is slightly less than the minimum inner diameter of the threaded bore; in this fashion, the inner periphery of the gasket normally extends into the bore slightly.

A dispensing spout designated generally as 16 is provided with an open end 16.1 to which the flexible hose 12.1 (FIG. 1) may be connected, and a closed end 16.2. The dispensing spout is generally tubular, as shown best in FIG. 2, and smooth, rounded threads matching the threads in the bore of the collar are formed in the external, generally cylindrical walls 16.3 of the spout. The threads in the spout may be formed by various metal working procedures for bending the threads into the relatively thin walls of the spout. The spout desirably has only six or seven threads, so that it may be completely threaded into or out of the bore in six or seven turns. As depicted best in FIG. 2, the closed end 16.2 of the spout presents a generally flat external surface to which an external gripping tab 16.4 may be attached for gripping with the fingers to turn the spout. Intermediate its threaded length, the spout 16 is provided with a side opening 16.5.

As shown in FIGS. 2 and 3, the spout may be threaded into the threaded bore of the collar from either end. As the spout is threaded into the bore, the smooth threads of the spout encounter and deform the inwardly protruding edges of the gasket 14, causing the inner periphery of the gasket to deform into the shape of the spout threads. The gasket desirably is of sufficient thickness so that it encounters at least two adjacent threads of the spout. The resilient nature of the gasket causes it to hug the threaded spout, thereby providing a liquid-tight seal between the spout and collar.

The spout is threaded for a sufficient length at either side of the side opening 16.5 so that when the spout has been threaded fully into the collar (as shown in FIGS. 2 and 3), the side opening 16.5 is positioned interiorly of the gasket 14 so as to open into the interior of the container. The outer edges of the side opening 16.5 may be slightly beveled and are quite smooth to avoid causing injury to the gasket when the spout is threaded into the collar. Although but a single side opening 16.5 is shown in the embodiment depicted in FIGS. 2–5, it is desired that a number of side openings 16.5 be spaced circumferentially of the spout, each spaced from the closed end 16.2 of the spout by the same distance.

The gasket 14 may take the form of an O-ring 14.2, as depicted in FIG. 4, the O-ring being of a highly resilient material so as to deform and tightly hug the spout threads, desirably contacting at least two adjacent threads of the spout. In another embodiment, depicted in FIG. 5, a hollow O-ring 14.3 is provided as the gasket. Since the hollow O-ring may collapse upon itself to some extent, less free annular space within the collar to permit deformation is required.

It will be understood that the gasketing material which is employed is of rubber or other resilient material which offers resistance to softening when contacted with gasoline or such other liquid as may be employed in the container. Although the freshly installed gasket will extend a noticeable distance into the threaded bore of the collar, it will be understood that the gasket may eventually take a permanent set in a configuration of the threads of the spout. The gasket retains sufficient resilience so that it bears tightly against the threaded spout and thus provides a fluid-tight seal between the spout and the collar.

The collar 12.2 is preferably of cast or forged or sheet metal and has sufficient strength to not only tightly hold the gasket adjacent the outer periphery of the latter but also to provide a strong base into which the spout may be threaded. The threads of the collar bore desirably are smoothly rounded to the same general configuration as the threads of the spout, thus reducing any tendancy of the bore threads to damage the spout threads which might result in damage to the gasket through which the spout threads pass. The hose 12.1 may be of the spirally wound, jointed metal type known to the art, and neither the spout nor the hose has a diameter exceeding the diameter of the collar bore 12.4.

In use, the spout is unscrewed from its closure position depicted in FIG. 2, using the grasping tab 16.4 for turning the spout out of the collar. The spout is reversed end for end, and its closed end is screwed into the collar to the position shown in FIG. 3, the threaded spout section in each position coming into sealing engagement with the gasket 14. In the closure position shown in FIG. 2, gasoline or other fluid from within the container may freely pass into and out of the side opening 16.5 in the spout, but because the side opening is blocked from direct communication with the exterior of the container by the gasket 14, no liquid can escape. Similarly, when the spout is in the pouring position shown in FIG. 3, the side opening 16.5 is again below the gasket level, and gasoline or other liquid from the container may enter the spout through the side opening 16.5 and then flow outwardly through the flexible hose 12.1. Of importance in the present invention is the fact that whether the spout is in the closure or pouring positions depicted in FIGS. 2 and 3, respectively, the side openings 16.5 of the spout are always interior with respect to the gasket 14; that is, the gasket must make at least a small complete seal about the threaded spout at a point which is above, or exterior of, the location of the side opening 16.5.

Figure 5:
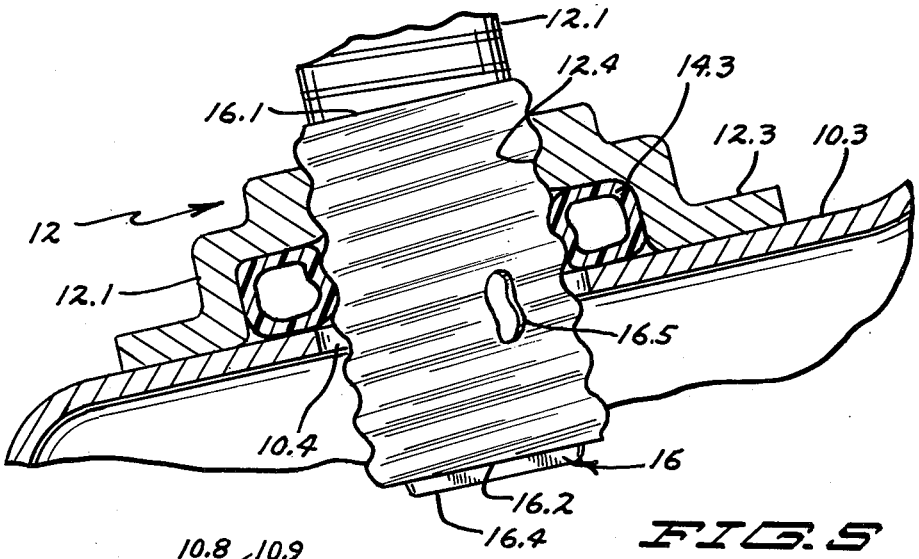

The annular gasket may easily be replaced merely by pulling the same from its seating engagement between the top wall 10.3 of the container and the collar 12.2, and then manually forcing the replacement gasket into position. Repeated use of the replacement gasket results in that gasket taking on the configuration of the threaded exterior of the spout and also aids the gasket in seating tightly within its annualr recess. The O-ring type gaskets shown in FIGS. 4 and 5 are particularly desirable because of the ease with which they can be put in place during manufacture of the dispenser of the invention, and because of the ease with which they can be replaced.

Figure 6:
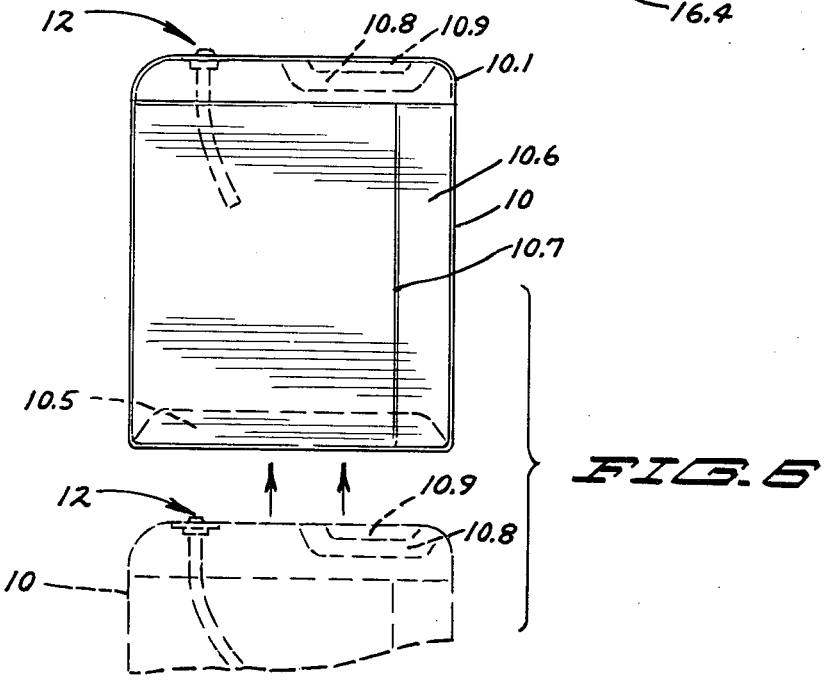
FIG. 6 is a schematic, partially broken away view showing the nesting of one container in another for storage, as facilitated by the dispenser of the invention.
Figure 7:
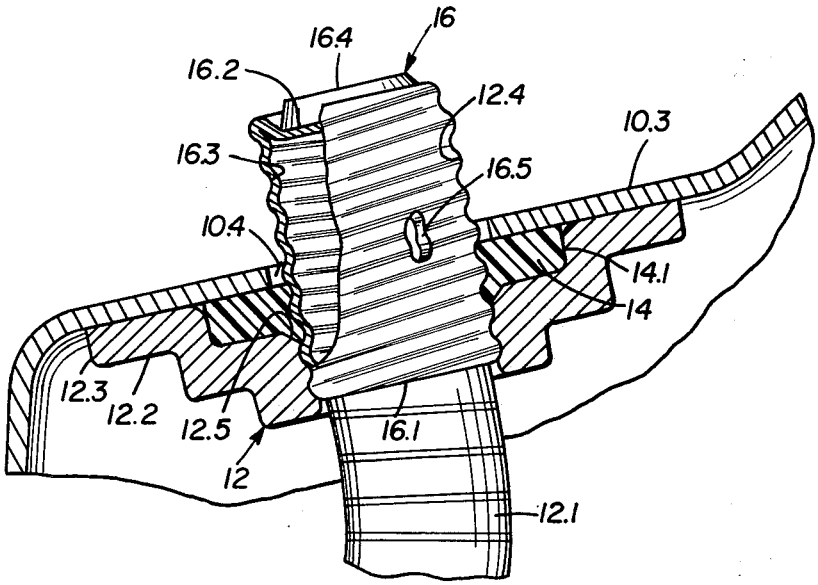
FIG. 7 is a broken away, detailed cross-sectional view representing a modification of the dispenser shown in FIG. 2.

It will be understood that the collar 12.2 need not be placed upon the outer surface of the container wall 10.3 but may instead be affixed to the inner surface of that wall, as shown in FIG. 7. When affixed to the inner surface of the top wall, containers equipped with the dispenser of the invention may be readily nested one upon another, as shown in FIG. 6, and moreover may be inexpensively manufactured. Referring to FIG. 6, the top and bottom walls of the container, designated respectively 10.1 and 10.5, may be made to nest one within the other and may originate with single sheets of sheet metal stamped into the rounded, dished configuration depicted in FIG. 6 with the lower edges of these walls being substantially vertical. The body 10.6 of the container may be made from a single piece of sheet metal bent into a generally tubular configuration with the ends of the metal sheet bonded together by welding or the like, as shown at 10.7 in FIG. 6. The dished metal sheet selected for the upper wall 10.1 may then be provided with a depression 10.8 at one end across which a handle 10.9 may be welded, and may be equipped with the dispenser 12 of the invention at its other end, the dispenser being mounted on the inner, or lower surface of the wall 10.1 as depicted in FIG. 7, for example. The top and bottom walls 10.1, 10.5 may then be affixed to the open top and bottom of the body 10.6 by welding or the like to complete the container.

While I have described a preferred embodiment of the present invention, it should be understood that various changes, adaptations, and modifications may be made therein without departing from the spirit of the invention and the scope of the appended claims.

What is claimed:

1. A container with a dispenser having reversible closure and pouring positions, the dispenser comprising:

a collar mounted to a wall of the container and having an internally threaded bore open to the container interior, the collar holding and restraining an internal, deformable, annular gasket extending normally radially inwardly slightly of the threads of the bore; and an elongated, hollow dispensing spout having an open end and a closed end with a side opening in the spout spaced from the closed end, the spout having an exteriorly threaded surface portion free of obstructions and adjacent its closed end for threading the spout from either end into the collar bore with the threaded surface portion of the spout extending a sufficient distance on each side of the side opening so as to sealingly engage and deform the annular gasket held by the collar with the side opening of the spout open to the container interior in both the closed and pouring positions.

2. The container and dispenser of claim 1 wherein threads comprising the threaded portion of the spout are rounded and smooth, whereby damage resulting from the encounter of the threaded spout with the gasket is avoided.

3. The container and dispenser of claim 2 in which the spout is of thin-walled material with the threaded portion bent therein.

4. The container and dispenser of claim 2 in which the gasket is of sufficient thickness to simultaneously encouner at least two adjacent threads of the threaded portion of the spout. encounter

5. The container and dispenser of claim 4 in which the threaded portion of the spout includes not more than about seven threads.

6. The container and dispenser of claim 1 in which the spout includes a plurality of circumferentially spaced side openings each spaced axially the same distance from the closed end of the spout.

7. The container and dispenser of claim 2 wherein threads comprising the threaded portion of the collar bore are rounded and smooth and in matching configuration to the rounded, smooth threads of the threaded portion of the spout, whereby damage to the smooth spout threads may be avoided.

8. The container and dispenser of claim 1 in which the collar includes an annular recess confronting the container wall to which the collar is mounted, and wherein the annular gasket is confined within the annular recess and against the confronting wall of the container.

9. The container and dispenser of claim 8 wherein the gasket is a resilient O-ring.

10. The container and dispenser of claim 9 in which the O-ring gasket is hollow.

11. A container with a dispenser having reversible closure and pouring positions, the dispenser comprising a. a collar mounted to a wall of the container and having an internally threaded bore opened to the container interior, the threaded bore having smooth, rounded threads, the collar including an internal, annular recess confronting the wall of the container to which the collar is mounted;

b. a deformable, annular gasket seated within the annular recess of the collar and bearing against the confronting wall of the container, the inner periphery of the gasket extending normally inwardly slightly of the threads of the bore; and c. an elongated, thin-walled dispensing spout having an open end and a closed end with a plurality of circumferentially spaced side openings in the spout each spaced the same distance from, and adjacent to, the closed end, the spout having adjacent its closed end an exteriorly threaded portion free from obstructions and with smooth, rounded threads for threading the spout from either spout end into the collar bore with the threaded portion of the spout extending a sufficient distance on each side of the side openings so as to sealingly engage and deform the deformable gasket seated within the annular recess of the collar with the side openings of the spout open to the container interior in both the closed and pouring positions.

12. The container and dispenser of claim 11 in which the gasket is of sufficient width to engage at least two adjacent smooth threads of the threaded portion of the spout.

13. The container and dispenser of claim 1 in which the collar is mounted to an interior container wall surface and in which the container includes top, bottom and side walls with the top and bottom walls having a similar dished configuration to nest one within another, whereby said containers may be nested one upon another during storage.

* * * * *